US010337809B2

(12) United States Patent
Shipley et al.

(10) Patent No.: US 10,337,809 B2
(45) Date of Patent: Jul. 2, 2019

(54) MAGAZINE FOR CASED TELESCOPED AMMUNITION CARTRIDGES WITH SIDE-WALLS HAVING CARTRIDGE ORIENTATION RIBS

(71) Applicant: AAI Corporation, Hunt Valley, MD (US)

(72) Inventors: Paul Andrew Shipley, Millers, MD (US); Joshua Stephen Ruck, Baltimore, MD (US); Benjamin Tyler Cole, Baltimore, MD (US); Brandon Scott Recchia, Parkton, MD (US); Cameron Mehdi Brand, Bel Air, MD (US); Gregory Paul Habiak, Bryn Mawr, PA (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 16/044,244

(22) Filed: Jul. 24, 2018

(65) Prior Publication Data

US 2019/0033023 A1 Jan. 31, 2019

Related U.S. Application Data

(60) Provisional application No. 62/536,445, filed on Jul. 24, 2017, provisional application No. 62/536,448,
(Continued)

(51) Int. Cl.
*F41A 9/61* (2006.01)
*F41A 3/34* (2006.01)
(Continued)

(52) U.S. Cl.
CPC ..... *F41A 3/34* (2013.01); *F41A 3/10* (2013.01); *F41A 5/18* (2013.01); *F41A 9/66* (2013.01);
(Continued)

(58) Field of Classification Search
CPC ..... F41A 9/65; F41A 9/66; F41A 9/82
(Continued)

(56) References Cited

U.S. PATENT DOCUMENTS 4,487,103 A 12/1984 Atchisson
4,688,344 A 8/1987 Kim
(Continued)

FOREIGN PATENT DOCUMENTS

DE 45561 C 12/1888
EP 0248772 A2 12/1987
WO 2017197415 A2 11/2017

OTHER PUBLICATIONS

"ARES-Olin AIWS", Gun Wiki, RANDOM powered by Wikia, Year designed: 1987, <<http://guns.wikia.com/wiki/ARES-Olin_AIWS>> article accessed Jul. 31, 2018, 4 pages.
(Continued)

*Primary Examiner* — J. Woodrow Eldred
(74) *Attorney, Agent, or Firm* — BainwoodHuang

(57) ABSTRACT

A magazine for storing cased telescoped (CT) cartridges. The magazine includes vertically extending side-wall ribs that project inwards into a loading channel. The side-wall ribs are positioned in alignment with a circumferential groove in each CT cartridge. The side-wall ribs prevent a backwards oriented CT cartridge from being pushed from the loading position through the loading channel into a body of the magazine. A moveable lip at the top of the magazine may move out of the way when the magazine is attached to a firearm, to allow the CT cartridge located in the loading position to be fed vertically out of the top of magazine. Each CT cartridge may include a thermal protective insert that provides thermal insulation from heat emanating from a barrel of a firearm when the CT cartridge is located in a chamber of the firearm.

11 Claims, 15 Drawing Sheets

Related U.S. Application Data filed on Jul. 24, 2017, provisional application No. 62/536,451, filed on Jul. 24, 2017.

(51) Int. Cl.

| | |
|---|---|
| ***F41A 9/66*** | (2006.01) |
| ***F41A 9/75*** | (2006.01) |
| ***F41A 9/67*** | (2006.01) |
| ***F41A 9/69*** | (2006.01) |
| ***F41A 3/10*** | (2006.01) |
| ***F41A 5/18*** | (2006.01) |
| ***F41A 21/12*** | (2006.01) |
| ***F41A 15/14*** | (2006.01) |
| *F42B 5/045* | (2006.01) |

(52) U.S. Cl.
CPC ..... *F41A 9/67* (2013.01); *F41A 9/69* (2013.01); *F41A 9/75* (2013.01); *F41A 15/14* (2013.01); *F41A 21/12* (2013.01); *F42B 5/045* (2013.01)

(58) Field of Classification Search
USPC ..... 42/50, 49.01
See application file for complete search history.

(56) References Cited

U.S. PATENT DOCUMENTS

| | | | | |
|---|---|---|---|---|
| 4,872,391 | A | 10/1989 | Stoner | |
| 5,117,735 | A | 6/1992 | Flashkes | |
| 6,389,947 | B1 | 5/2002 | Murello | |
| 6,637,310 | B2 | 10/2003 | Borgwarth | |
| 7,886,470 | B1 | 2/2011 | Doiron | |
| 8,776,419 | B2 | 7/2014 | Obermeit | |
| 8,807,039 | B2 | 8/2014 | Carpenter et al. | |
| 8,869,672 | B2 | 10/2014 | Smith | |
| 9,267,772 | B2 | 2/2016 | Carpenter et al. | |
| 9,638,484 | B1 | 5/2017 | Friend | |
| 2011/0094137 | A1* | 4/2011 | Fluhr | F41A 9/65 42/50 |
| 2013/0086834 | A1* | 4/2013 | Battaglia | F41A 9/65 42/49.02 |
| 2015/0176936 | A1 | 6/2015 | Wei | |
| 2015/0192377 | A1* | 7/2015 | Larson, Jr. | F41A 9/70 42/50 |
| 2015/0241162 | A1* | 8/2015 | Geraghty | F41A 35/02 42/6 |
| 2017/0328689 | A1 | 11/2017 | Dindl | |
| 2017/0328690 | A1 | 11/2017 | Dindl | |
| 2018/0066925 | A1 | 3/2018 | Skowron et al. | |

OTHER PUBLICATIONS

Notification of Transmittal of the International Search Report and the Written Opinion of the International Searching Authority, or the Declaration dated Dec. 11, 2018 from the International Searching Authority of the European Patent Office for International Application No.: PCT/US2018/043533, International Filing Date: Jul. 24, 2018, 13 pages.

* cited by examiner

MAGAZINE FOR CASED TELESCOPED AMMUNITION CARTRIDGES WITH SIDE-WALLS HAVING CARTRIDGE ORIENTATION RIBS

CROSS REFERENCE TO RELATED APPLICATIONS

The present application claims priority to the following United States Provisional Patent Applications filed on Jul. 24, 2017, the disclosures of which are hereby included by reference herein:

a) U.S. Provisional Patent Application No. 62/536,445, b) U.S. Provisional Patent Application No. 62/536,448, and c) U.S. Provisional Patent Application No. 62/536,451

STATEMENT REGARDING FEDERALLY SPONSORED RESEARCH OR DEVELOPMENT

This invention was made with government support under W15QKN-12-9-0001/DOTC-14-01-INIT524 MOD11 awarded by the US Army. The government has certain rights in the invention.

TECHNICAL FIELD

The present disclosure relates generally to semi-automatic and/or fully automatic firearms that are designed to fire cased telescoped ammunition, such as rifles, carbines, machine guns, submachine guns, handguns, etc., and more specifically to magazines for storing cased telescoped (CT) ammunition cartridges that prevent CT cartridges from being loaded with an incorrect orientation.

BACKGROUND

Most traditional firearm ammunition cartridges are constructed using a metal shell casing (e.g. a brass casing). The metal casing of a traditional cartridge typically contains some amount of propellant (e.g. gunpowder, smokeless powder, etc.) in a rearward portion of the cartridge that is sometimes referred to as the cartridge "body". The metal casing of a traditional casing also holds a projectile in a frontward portion of the cartridge that is sometimes referred to as the cartridge "neck". Traditional metal cartridge cases typically have a tapered shape, in which a relatively wider diameter body steps down to a relatively smaller diameter neck. When a traditional metal case cartridge is fired, the propellant contained in the metal casing is ignited. Gases resulting from the burning of the propellant pressurize and expand the metal casing against the wall of the chamber, and push against the base of the brass casing, causing the projectile to be expelled from the front of the cartridge and through the barrel of the firearm.

In contrast to traditional metal case cartridges, cased telescoped (CT) ammunition cartridges completely encase the propellant and the projectile within a cylindrical shell that is made of polymer. By eliminating the relatively heavy metal casing used in traditional metal case ammunition, CT ammunition provides a significant reduction in ammunition weight, enabling relatively larger numbers of rounds to be carried per unit weight, e.g. by infantry soldiers.

As it is generally known, a magazine is an ammunition storage and feeding device that can be attached to a repeating firearm to provide cartridges to the firearm for the firearm to fire. Removable magazines can be detached from the well of the firearm, reloaded, and then re-attached to the firearm. Magazines generally function by moving the cartridges they store into a position from which the cartridges can be loaded into a chamber of the firearm. Magazines generally include a feed mechanism, e.g. a spring-loaded follower. The feed mechanism of the firearm removes cartridges from the magazine during the feed process, and every time a cartridge is fed into the firearm, a next cartridge is moved toward the feed position in the magazine.

SUMMARY

Designing a magazine for storage of cased telescoped (CT) ammunition introduces technical challenges with regard to ensuring that the CT cartridges are loaded into the magazine with a proper orientation. If a cartridge is loaded into a magazine with a backwards orientation, and the backwards loaded cartridge is subsequently fed into the firearm, the cartridge will fail to fire. In order to prevent this type of failure, previous cartridge magazine designs have relied on the tapered shape of metal case cartridges to prevent cartridges from being loaded into the magazine with a backwards orientation. However, CT cartridges may be primarily or completely cylindrical in shape, and accordingly a new magazine design is needed for storing CT cartridges that does not rely on the tapered shape of a cartridge, and that prevents cylindrical CT cartridges from being loaded backwards into the magazine.

In order to address the above described and other shortcomings of previous magazine designs, a magazine is described herein that is configured to store cased telescoped (CT) cartridges, and that prevents CT cartridges from being loaded in an incorrect orientation. The magazine described herein includes two side-walls extending along a length of a loading channel, and two end-walls extending along a width of the loading channel, connecting the sidewalls. Each one of the side-walls includes a vertically extending side-wall rib that projects inwards into the loading channel. The side-wall ribs are located opposite each other and positioned in alignment with a location of a circumferential groove provided in each CT cartridge that is to be loaded into the magazine. The side-wall ribs prevent a backwards oriented CT cartridge from being pushed from a top most loading position in the magazine through the loading channel into a body of the magazine.

In some embodiments, the magazine may include a spring-loaded follower having a predominantly rectangular top shape matching a rectangular profile of the CT cartridges to be loaded into the magazine. The rectangular top shape of the spring-loaded follower may further include cutaways corresponding to the side-wall ribs that allow the spring-loaded follower to move upwards and downwards through the loading channel without interference from the side-wall ribs.

In some embodiments, a front one of the end-walls may define at least a portion of a loading window through which a CT cartridge can be loaded axially into the loading position, and the side-wall ribs may be located below the loading position, such that the side-wall ribs do not interfere with loading the CT cartridge axially into the loading position through the loading window.

In some embodiments one of the end-walls located at the back of the magazine may prevent the CT cartridge from being pushed axially out of the magazine from the loading position when the CT cartridge is being loaded axially into the loading position through a loading window in the front of the magazine.

In some embodiments, after loading a CT cartridge into the loading position, the CT cartridge must be pushed downwards past the side-wall ribs to be loaded into the body of the magazine.

The body of the magazine may be embodied as a box, high capacity drum, or some other type of magazine body.

In some embodiments, in which a spring-loaded follower pushes CT cartridges loaded in the magazine upwards towards the loading position, each of the side-walls includes a top curved portion adjacent to the loading position and curving inwardly over a top of the magazine. The top curved portions of the side-walls prevent a CT cartridge located in the loading position from being pushed by the spring-loaded follower upwards out of the top of the magazine, and are examples of what are generally referred to as magazine lips.

In some embodiments, the curved portion of a first one of the side-walls is a moveable lip that is operable to pivot laterally out of the way of the CT cartridge located in the loading position, in response to the magazine being attached to a firearm. When the moveable lip is pivoted out of the way of the CT cartridge located in the loading position, the CT cartridge located in the loading position is fed vertically out of the top of the magazine into the firearm to which the magazine is attached. The curved portion of a second one of the side-walls may be a fixed lip that does not move.

In some embodiments, each CT cartridge to be loaded into the magazine may include a thermal protective insert located in a front end of the cartridge. The thermal protective insert provides thermal insulation from heat emanating from the barrel of a firearm to which the magazine is attached when the CT cartridge is located in a chamber of the firearm.

Magazines using embodiments of the disclosed mechanisms may provide significant advantages over previous magazines. For example, the disclosed side-wall ribs prevent loading of a backwards CT cartridge into the body of the magazine. In another example, the moveable lip that moves out of the way of the CT cartridge located in the loading position allows the CT cartridge located in the loading position to be pushed vertically out of the top of the magazine and into the firearm to which the magazine is attached, while still preventing the CT cartridge located in the loading position from being pushed out the top of the magazine by the spring-loaded follower when the magazine is not attached to a firearm. The disclosed thermal protective insert located at the front of the CT cartridge prevents heat emanating from the barrel of the firearm into which the CT cartridge is loaded from causing damage to the polymer casing of the CT cartridge, and/or causing the CT cartridge to inadvertently fire.

BRIEF DESCRIPTION OF THE DRAWINGS

The foregoing and other objects, features and advantages will be apparent from the following description of particular embodiments of the disclosed technology, as illustrated in the accompanying drawings in which like reference characters refer to the same parts throughout the different views. The drawings are not necessarily to scale, emphasis instead being placed upon illustrating the principles of various embodiments of the disclosed technology.

DETAILED DESCRIPTION

Figure 1:
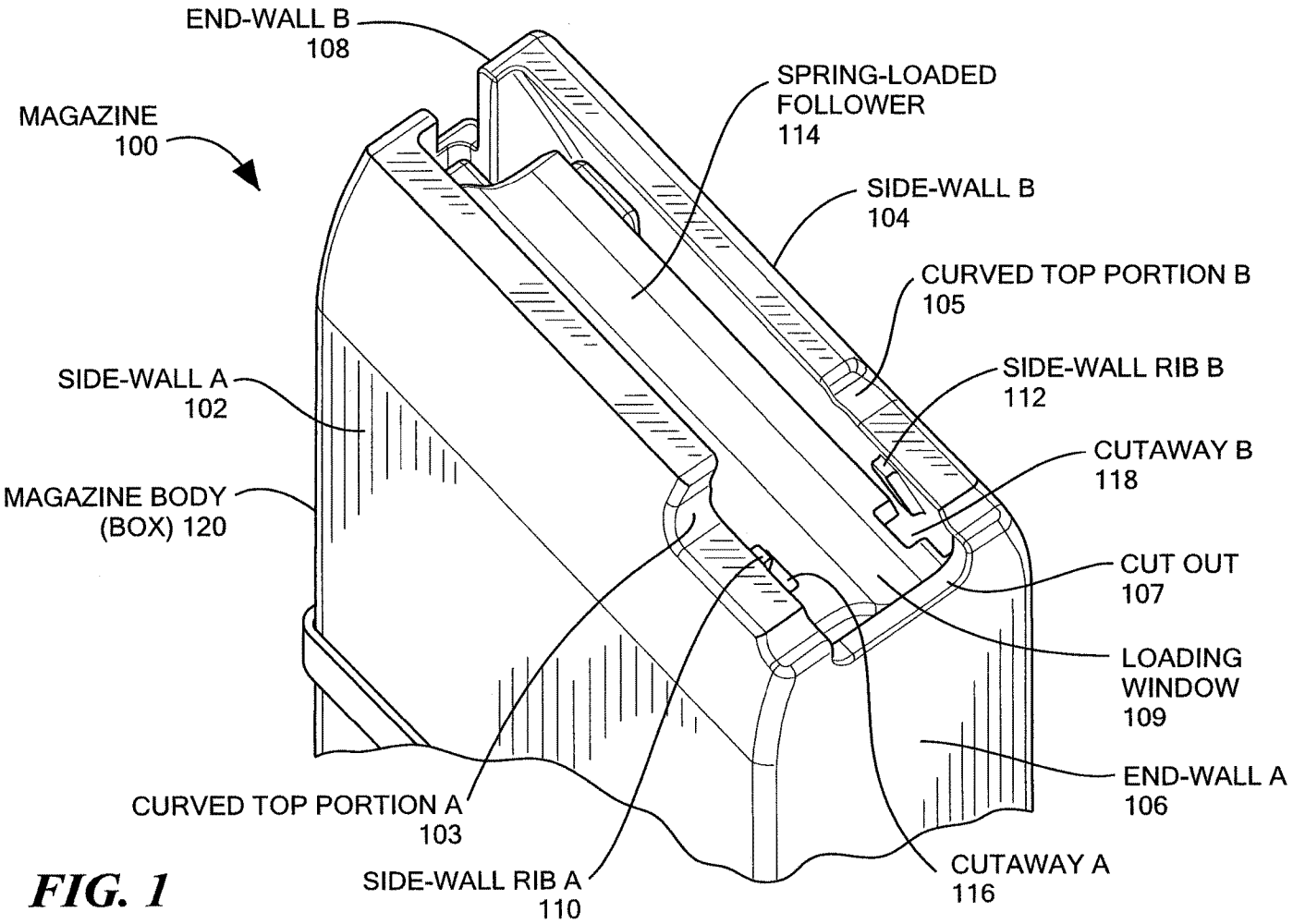
FIG. 1 shows a first example of a magazine configured to store cased telescoped (CT) cartridges and to prevent CT cartridges from being loaded in an incorrect orientation.

Embodiments of the invention will now be described. It should be understood that such embodiments are provided by way of example to illustrate various features and principles of the invention, and that the invention hereof is broader than the specific examples of embodiments provided herein.

The embodiments described herein include a magazine that prevents CT cartridges from being loaded in an incorrect orientation. In the disclosed magazine, two side-walls extend along a length of a loading channel, and two end-walls extend along a width of the loading channel, connecting the sidewalls. Each side-wall includes a vertically extending side-wall rib that projects inwards into the loading channel. The side-wall ribs disclosed herein are located opposite each other and positioned in alignment with a location of a circumferential groove provided in each CT cartridge to be loaded into the magazine. The disclosed side-wall ribs prevent a backwards oriented CT cartridge from being pushed from a top-most position in the magazine (referred to herein as the "loading position") through the loading channel into a body of the magazine. The magazine may include a spring-loaded follower having a predominantly rectangular top shape matching a rectangular profile of CT cartridges, with cutaways corresponding to the side-wall ribs that allow the spring-loaded follower to move upwards and downwards through the loading channel without interference from the side-wall ribs. The magazine may include a loading window through which a CT cartridge can be loaded axially into the loading position, and the side-wall ribs may be located below the loading position, such that the side-wall ribs do not interfere with loading the CT cartridge axially into the loading position through the loading window. An end-wall opposite the loading window prevents a CT cartridge from being pushed axially out of the magazine when the CT cartridge is being loaded axially into the loading position. After loading a CT cartridge into the loading position, the CT cartridge must be pushed downwards past the side-wall ribs to be loaded into the body of the magazine. In various embodiments, the body of the magazine may be a box, a high capacity drum, or some other type of magazine body.

Each of the side-walls may include a top curved portion adjacent to the loading position and curving inwardly over the top of the magazine to prevent a CT cartridge located in the loading position from being pushed upwards out of the magazine by the upward force of the spring-loaded follower. Such curved portions are examples of features generally referred to as magazine lips. In some embodiments, the curved portion of a first one of the side-walls may include or consist of a moveable lip that is operable pivot laterally out of the way of the CT cartridge located in the loading position, when the magazine is inserted into the magazine well of a firearm. When the moveable lip is pivoted out of the way of the CT cartridge located in the loading position, the CT cartridge located in the loading position can be fed vertically out of the top of the magazine into the firearm to which the magazine is attached. A curved portion of a second one of the side-walls may be a fixed lip that does not move. A thermal protective insert may be located in the front end of each CT cartridge to provide thermal insulation from heat emanating from the barrel of a firearm when the CT cartridge is located in the chamber of the firearm.

FIG. 1 shows an example of a Magazine 100 configured to store cased telescoped (CT) cartridges and to prevent CT cartridges from being loaded in an incorrect orientation. The Magazine 100 includes two side-walls, shown as Side-Wall A 102 and Side-Wall B 112.

Side-Wall A 102 and Side-Wall B 104 extend along the sides of the Magazine 100, including along a length of a loading channel through which CT cartridges must pass to be loaded into a body of the Magazine 100. Magazine 100 also includes two end-walls, shown as End-Wall A 106 and End-Wall B 108. End-Wall A 106 and End-Wall B 108 extend along the ends of the Magazine 100, including along a width of the loading channel. End-Wall A 106 and End-Wall B 108 connect Side-Wall A 102 and Side-Wall B 104.

Side-Wall A 102 and Side-Wall B 104 each include a vertically extending side-wall rib that projects inwards into the loading channel. For example, Side-Wall A 102 includes Side-Wall Rib A 110, and Side-Wall B 104 includes Side-Wall Rib B 112. Side-Wall Rib A 110 and Side-Wall Rib B 112 are located opposite each other and positioned in alignment with a location of a circumferential groove provided in each CT cartridge that is to be loaded into the magazine. Side-Wall Rib A 110 and Side-Wall Rib B 112 prevent a backwards oriented CT cartridge from being pushed from the loading position in the Magazine 100 through the loading channel into a body of the Magazine 100. The loading channel of the Magazine 100 may be considered to be the space between Side-Wall Rib A 110 and Side-Wall Rib B 112 on the interior of Magazine 100.

Magazine 100 is further showing including a Spring-Loaded Follower 114 that pushes CT cartridges loaded into the Magazine 100 upwards towards the loading position. Spring-Loaded Follower 114 has a predominantly rectangular top shape matching a rectangular profile of the CT cartridges to be loaded into the magazine. The rectangular top shape of the Spring-Loaded Follower 114 further includes two cutaways, shown by Cutaway A 116 and Cutaway B 118. Cutaway A 116 corresponds to Side-Wall Rib A 110, and Cutaway B 118 corresponds to Side-Wall Rib B 112. Cutaway A 116 and Cutaway B 118 allow the Spring-Loaded Follower 114 to move upwards and downwards through the loading channel without interference from Side-Wall Rib A 110 and Side-Wall Rib B 112.

End-Wall A 106 is a front one of the end-walls in Magazine 100, and includes a Cut Out 107 that defines at least a lower portion of a Loading Window 109 through which a CT cartridge can be loaded axially into the loading position. In Magazine 100 Side-Wall Rib A 102 and Side-Wall Rib B 104 are located below the loading position, such that Side-Wall Rib A 102 and Side-Wall Rib B 104 ribs do not interfere with loading a CT cartridge axially into the loading position through the Loading Window 109. For example, after a user axially loads a CT cartridge into the loading position of Magazine 100, through Loading Window 109, the CT cartridge must be pushed downwards past Side-Wall Rib A 110 and Side-Wall Rib B 112 for the CT cartridge to be loaded into the body of the magazine, shown by Magazine Body 120. In the example of FIG. 1, Magazine 100 includes a box type magazine body.

In Magazine 100, End-Wall B 108 is a back one of the end-walls, and prevents a CT cartridge from being pushed axially out of the Magazine 100 from the loading position when the CT cartridge is being loaded axially into the loading position.

Side-Wall A 102 and Side-Wall B 104 each include a top curved portion adjacent to the loading position and curving inwardly over the top of the Magazine 100, shown in FIG. 1 by Curved Top Portion A 103 in Side-Wall A 102 and Curved Top Portion B 105 in Side-Wall B 112. Curved Top Portion A 103 and Curved Top Portion B 105 prevent a CT cartridge located in the loading position from being pushed by the Spring-Loaded Follower 114 upwards out of the Magazine 100. Curved Top Portion A 103 and Curved Top Portion B 105 are examples of what are generally referred to as magazine feed lips.

Figure 2:
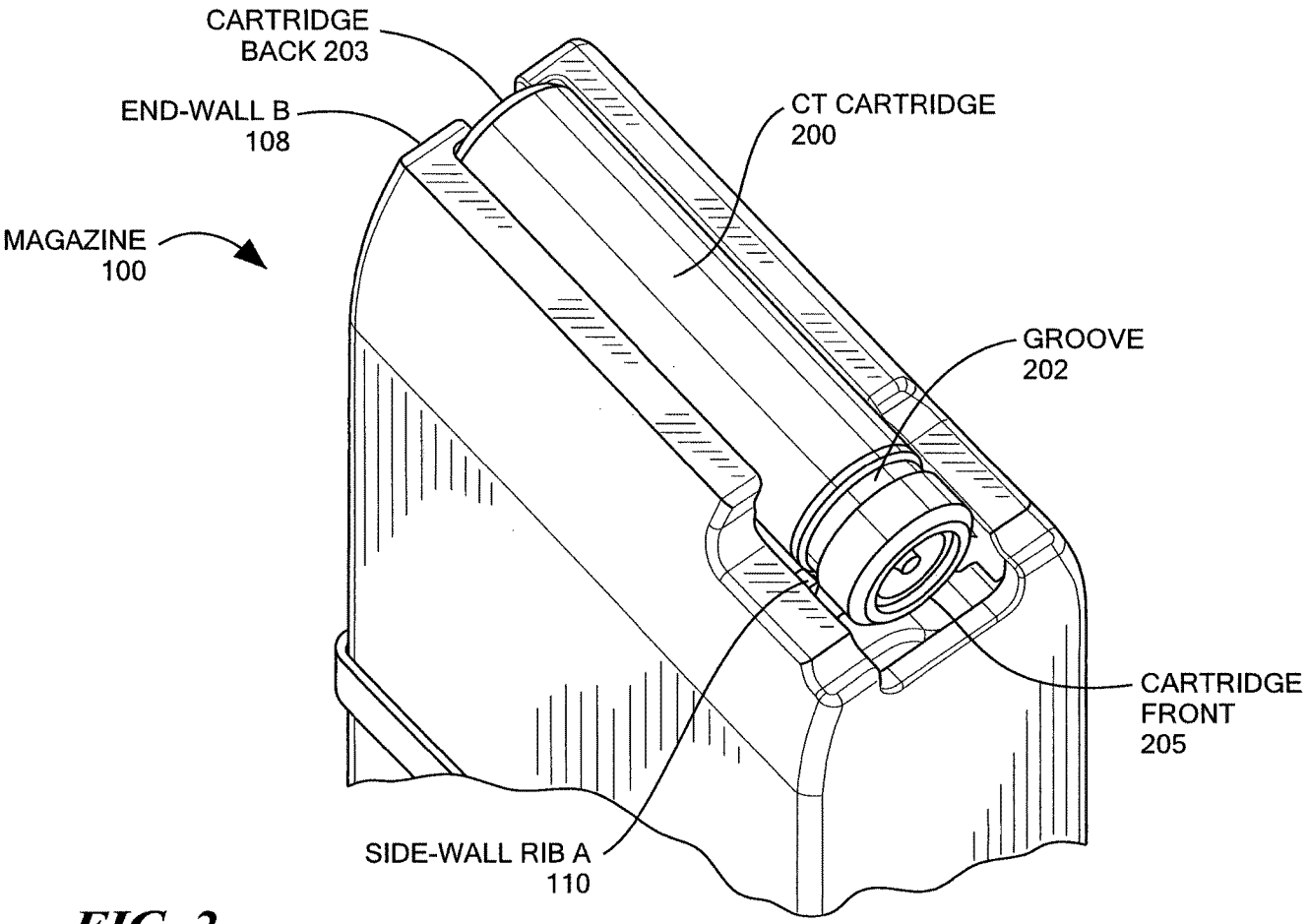
FIG. 2 shows the magazine of FIG. 1 with a CT cartridge located in a loading position.

FIG. 2 shows the Magazine 100 of FIG. 1 with a CT Cartridge 200 having been axially loaded into the loading position. In the example of FIG. 2, CT Cartridge 200 has been loaded with a correct orientation, i.e. with a Cartridge Back 203 of the CT Cartridge 200 located against the back end-wall of the Magazine 100, e.g. against End-Wall B 108. Accordingly, because CT Cartridge 200 has been loaded into the loading position with a correct orientation, the side-wall ribs can be engaged with a circumferential groove in CT Cartridge 200, shown by Groove 202. When the side-wall ribs are engaged with Groove 200, CT Cartridge 200 can be pushed downwards through the loading channel between the side-wall ribs into the body of the Magazine 100. In the example of FIG. 2, Groove 202 is shown located proximate to a Cartridge Front 205. In such embodiments, Groove 202 may alternatively be used to engage with a link that holds the CT Cartridge 200 in an ammunition belt that holds multiple CT cartridges, and that can be used to deliver the belted CT cartridges to a belt fed firearm. In this way, the Groove 202 located towards the Cartridge Front 205 may serve a function both when CT Cartridge 200 is fed in a magazine to a magazine-fed firearm, and when CT Cartridge 200 is fed in a belt to a belt-fed firearm. It should also be recognized that the disclosed mechanisms are not limited to embodiments in which the circumferential grooves in the CT cartridges are located proximate to the front of the CT cartridges. Alternatively, magazines may be provided with side-wall ribs that are located in positions corresponding to grooves provided in other locations along the CT cartridges. For example, a magazine may be provided with side-wall ribs located in positions corresponding to grooves in CT cartridges that are located proximate to Cartridge Back 203. In such embodiments, the circumferential groove may additionally be used to engage with an extractor mechanism in the firearm that pulls spent CT cartridges rearward from the firearm chamber during spent cartridge extraction, so that the spent CT cartridges can be effectively ejected from the firearm.

Figure 3:
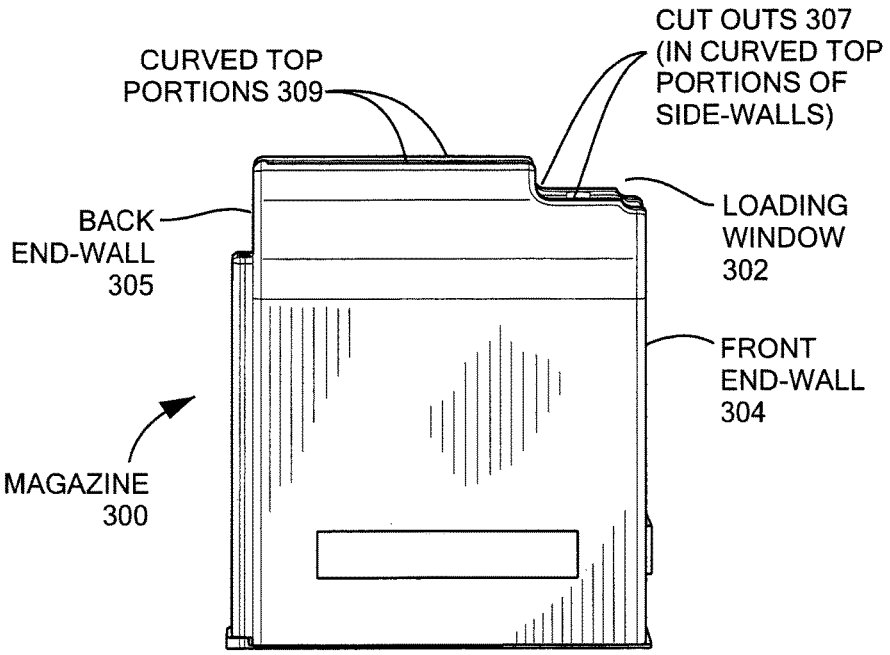
FIG. 3 a second example of a magazine configured to store CT cartridges and to prevent CT cartridges from being loaded in an incorrect orientation.

FIG. 3 is a side view of another example of a magazine for storing CT cartridges that prevents CT cartridges from being loaded in an incorrect orientation. In the example of FIG. 3, Magazine 300 is shown including a Front End-Wall 304 and a Back End-Wall 305. A Loading Window 302 in Magazine 300 allows CT cartridges to be loaded axially into a top most position in Magazine 300, referred to as the loading position. As shown in FIG. 1, the Loading Window 302 may be defined at least in part by a cut out in Front End-Wall 304. As shown in FIG. 3, Loading Window 302 may further be defined by Cut Outs 307 in the Curved Top Portions 309 in the side-walls of Magazine 300. Curved Top Portions 309 are examples of what are generally referred to as magazine feed lips.

Figure 4:
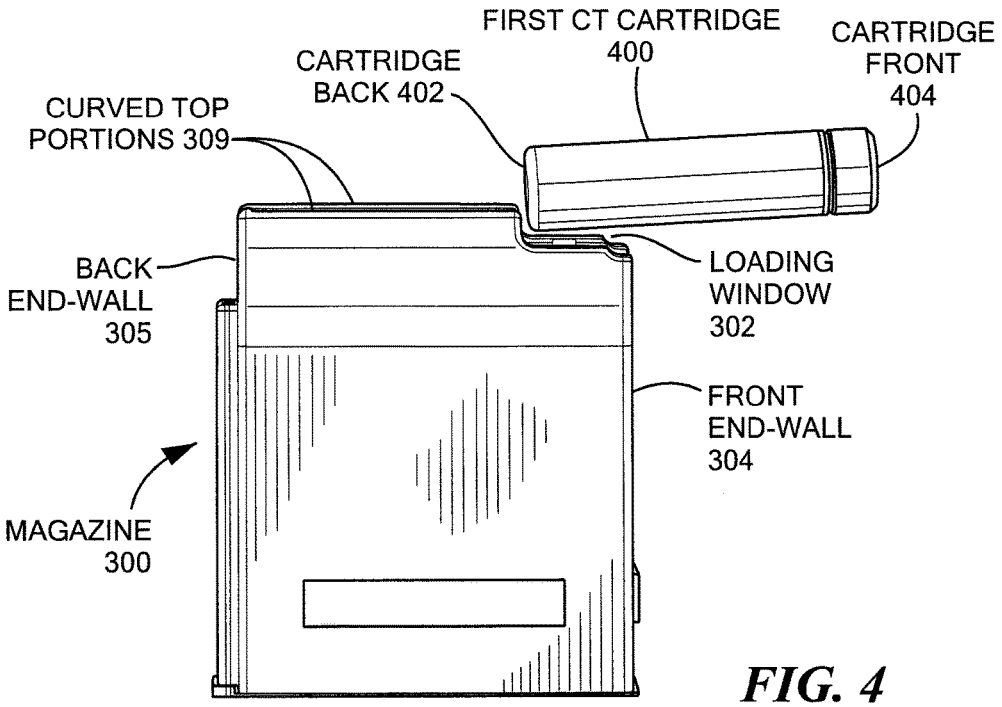
FIG. 4 shows the magazine of FIG. 3 and a first CT cartridge ready to be loaded into the magazine through a loading window.

FIG. 4 shows the Magazine 300 and a First CT Cartridge 400 to be loaded into Magazine 300 through the Loading Window 302, e.g. by a user when Magazine 300 is manually loaded. In FIG. 4, the First CT Cartridge 400 is shown being loaded into Magazine 300 with a correct orientation, i.e. Cartridge Back 402 is shown being the end of First CT Cartridge 400 that is pushed downwards (e.g. manually pushed by the user) first into the Loading Window 302, and under the Curved Top Portions 309 of the side-walls, so that when First CT Cartridge 400 is pushed (e.g. manually by the user) axially into the loading position, Cartridge Back 402 will be pushed up against Back End-Wall 305 and Cartridge Front 404 will end up located against Front End-Wall 304.

Figure 5:
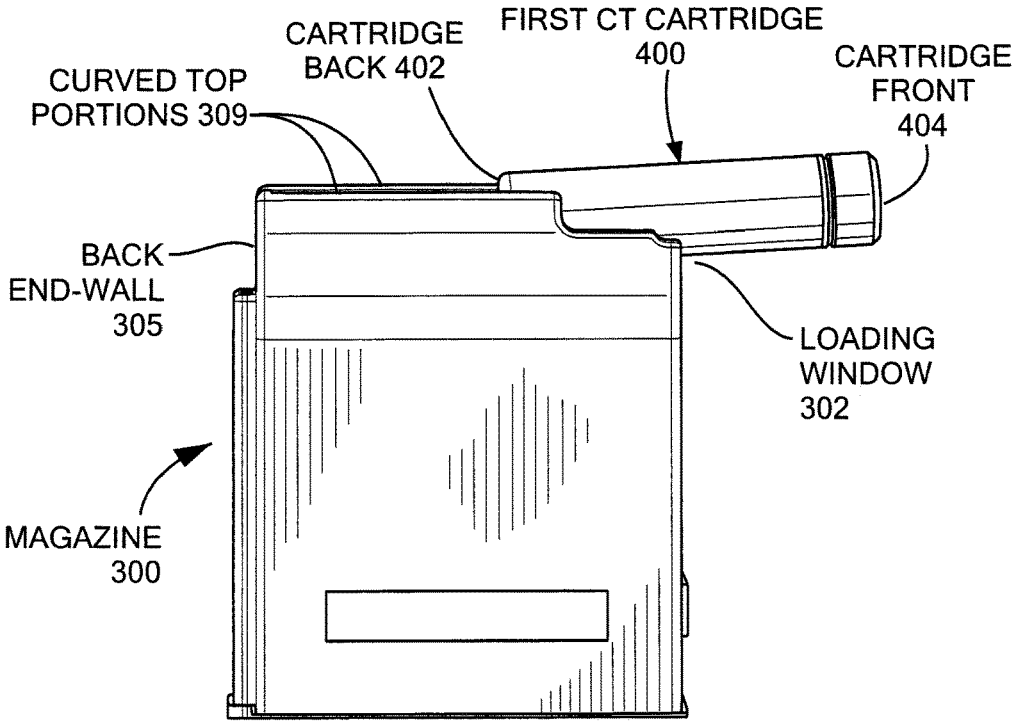
FIG. 5 shows the magazine of FIG. 3, with the first CT cartridge to be loaded being pushed rearward under the curved portions of the side-walls.

FIG. 5 shows the Magazine 300 with the Cartridge Back 402 of the First CT Cartridge 400 pushed further rearward into Magazine 300, through the Loading Window 302, and under the Curved Top Portions 309 of the side-walls of Magazine 300.

Figure 6:
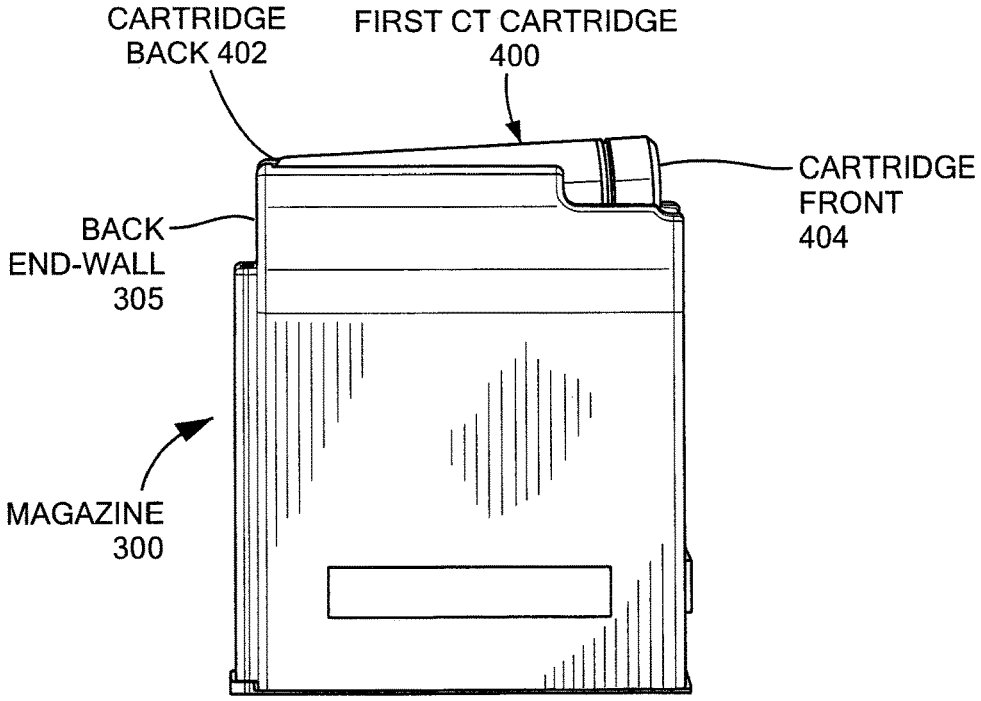
FIG. 6 shows the magazine of FIG. 3, with the first CT cartridge to be loaded pushed rearward under the curved portions of the side-walls to the back end-wall of the magazine.

FIG. 6 shows the Magazine 300 with the Cartridge Back 402 of the First CT Cartridge 400 pushed against Back End-Wall 305, such that First CT Cartridge 400 has been passed completely through Loading Window 302.

Figure 7:
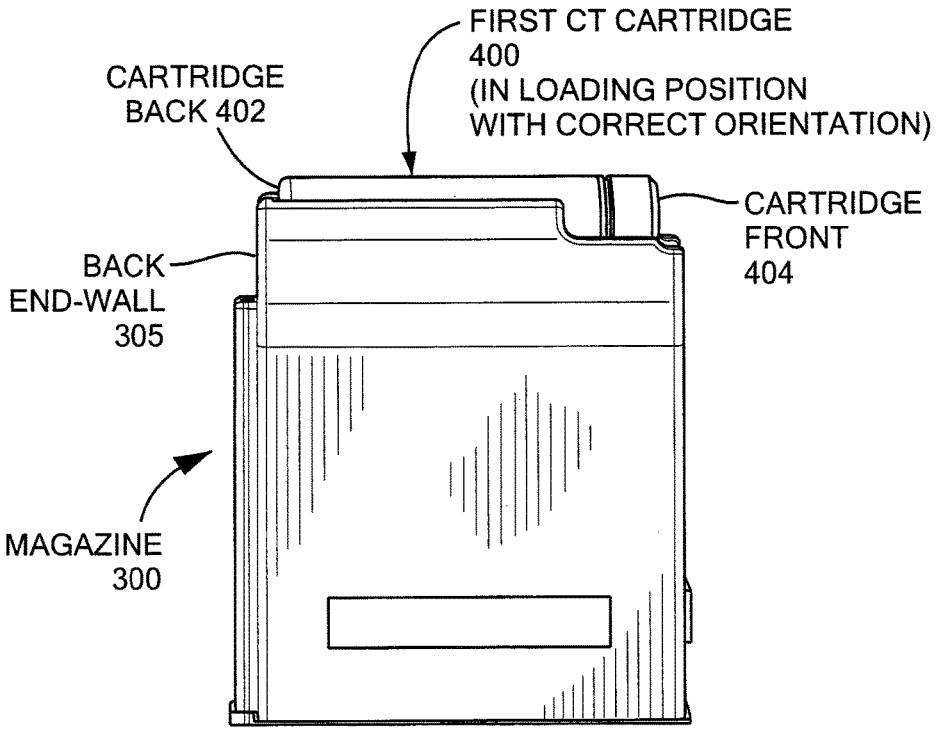
FIG. 7 shows the magazine of FIG. 3, with the first CT cartridge to be loaded into the magazine loaded into the loading position.

FIG. 7 shows the Magazine 300 with the Cartridge Front 404 of the First CT Cartridge 400 pushed downwards to bring First CT Cartridge 400 into alignment with the curved top portions of the side-walls of Magazine 300. FIG. 7 shows the First CT Cartridge 400 in the loading position, and correctly oriented, such that the Cartridge Back 402 is located against the Back End-Wall 305.

Figure 8:
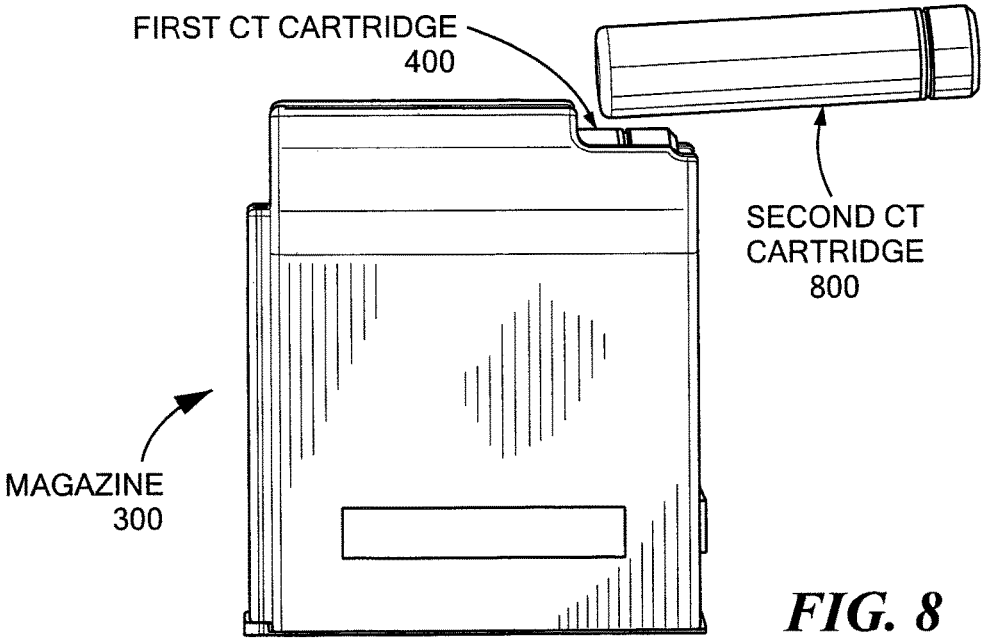
FIG. 8 shows the magazine of FIG. 3, with the first CT cartridge pushed down from the loading position into the loading channel, and a second CT cartridge to be loaded next.

FIG. 8 shows Magazine 300 and the First CT Cartridge 400, together with a Second CT Cartridge 800 to be loaded manually by the user into Magazine 300. As shown in FIG. 8, in order for the user to load the Second CT Cartridge 800 into the loading position, the First CT Cartridge 400 must be manually pushed downwards out of the loading position (e.g. by the user's thumb), through the loading channel, past the side-wall ribs. Because First CT Cartridge 400 has a correct orientation in Magazine 300, the circumferential groove in First CT Cartridge 400 will engage with the side-wall ribs and First CT Cartridge 400 will not be prevented from being pushed downwards through the loading channel into the body of Magazine 300. After First CT Cartridge 400 is pushed downwards through the loading channel, Second CT Cartridge 800 can be loaded into the loading position.

Figure 9:
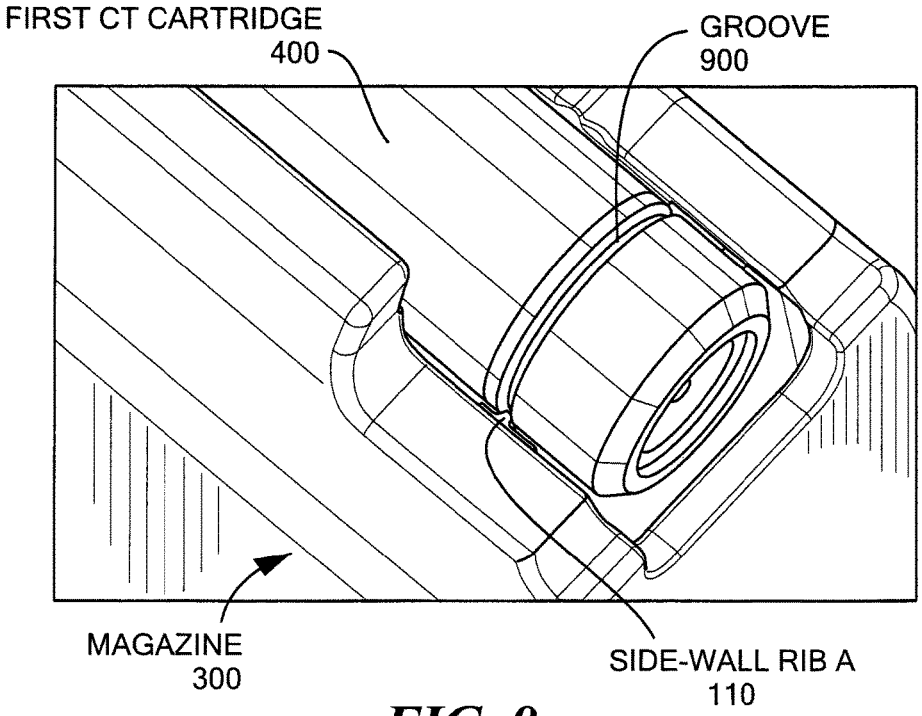
FIG. 9 shows a portion of the magazine of FIG. 3, showing the groove of the correctly oriented first CT cartridge engaged with one of the side-wall ribs, allowing the first CT cartridge to be pushed down through the loading channel into the body of the magazine.

FIG. 9 shows a portion of Magazine 300 and First CT Cartridge 400 with Side-Wall Rib A 902 engaged with the circumferential Groove 900 in correctly oriented First CT Cartridge 400 as First CT Cartridge 400 is successfully pushed downward through the loading channel into the body of Magazine 300.

Figure 10:
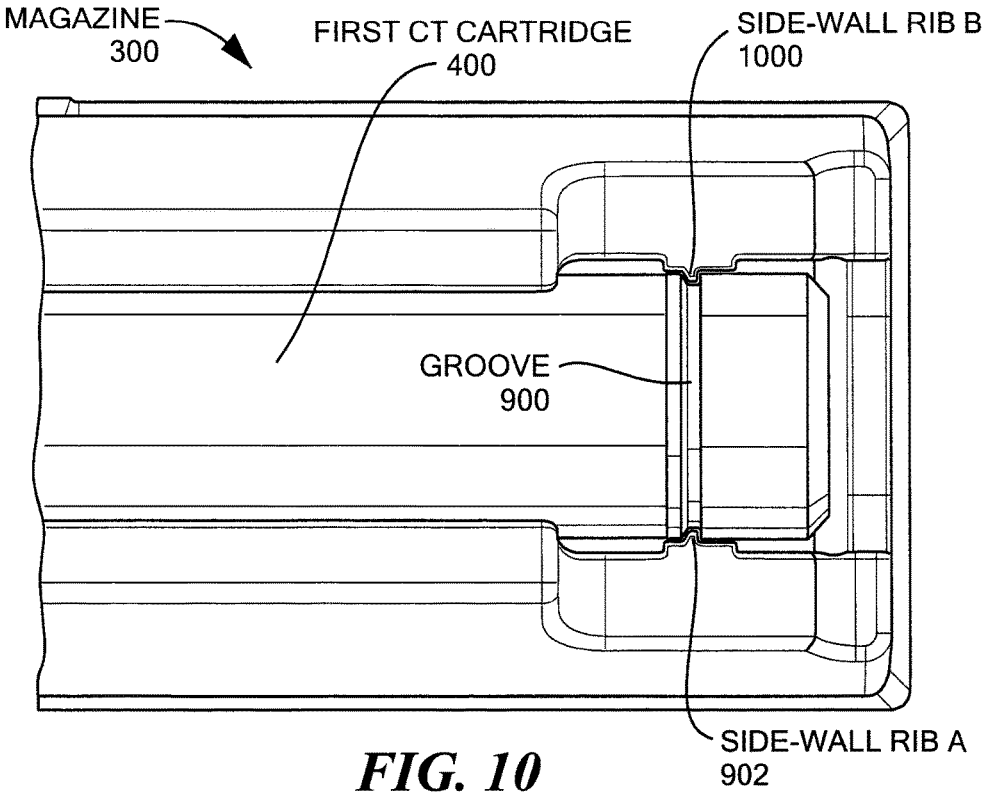
FIG. 10 is a top view showing a portion of the magazine of FIG. 3, with the groove of the correctly oriented first CT cartridge engaged with both of the side-wall ribs, allowing the first CT cartridge to be pushed down through the loading channel into the body of the magazine.

FIG. 10 is a top view showing a portion of Magazine 300 and First CT Cartridge 400 with Side-Wall Rib A 902 and Side-Wall Rib B 1000 engaged with the circumferential Groove 900 of the correctly oriented First CT Cartridge 400 as First CT Cartridge 400 is successfully pushed downward through the loading channel into the body of Magazine 300.

Figure 11:
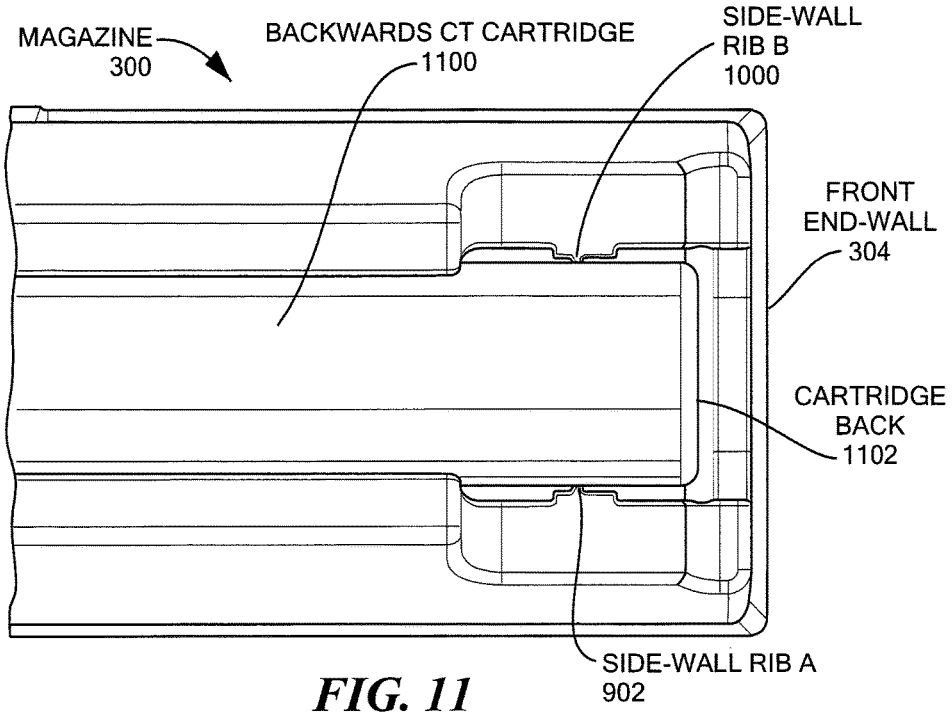
FIG. 11 is a top view showing a portion of the magazine of FIG. 3, with a backwards CT cartridge being prevented from being pushed down through the loading channel by the side-wall ribs.

FIG. 11 is a top view showing a portion of the Magazine 300 and showing a portion of a Backwards CT Cartridge 1100 being prevented from being pushed down through the loading channel by the Side-Wall Rib A 902 and Side-Wall Rib B 1000. As shown in FIG. 11, the Cartridge Back 1102 is located next to the Front End-Wall 304, indicating a backwards cartridge orientation. As a result, the circumferential groove in Backwards CT Cartridge 1100 is not engaged with Side-Wall Rib A 902 and Side-Wall Rib B 1000, and accordingly Side-Wall Rib A 902 and Side-Wall Rib B 1000 prevent Backwards CT Cartridge 1000 from being pushed down through the loading channel.

Figure 12:
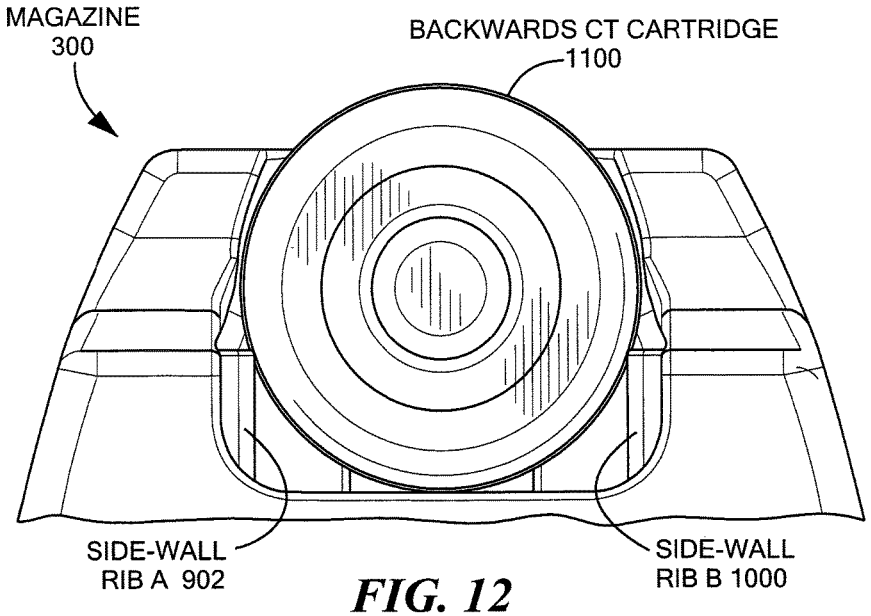
FIG. 12 is a side view showing a portion of the magazine of FIG. 3, and showing the backwards CT cartridge being prevented from being pushed down through the loading channel by the side-wall ribs.

FIG. 12 is a side view also showing a portion the Magazine 300 and also showing the Backwards CT Cartridge 1100 being prevented from being pushed downward through the loading channel by the Side-Wall Rib A 902 and Side-Wall Rib B 1000.

Figure 13:
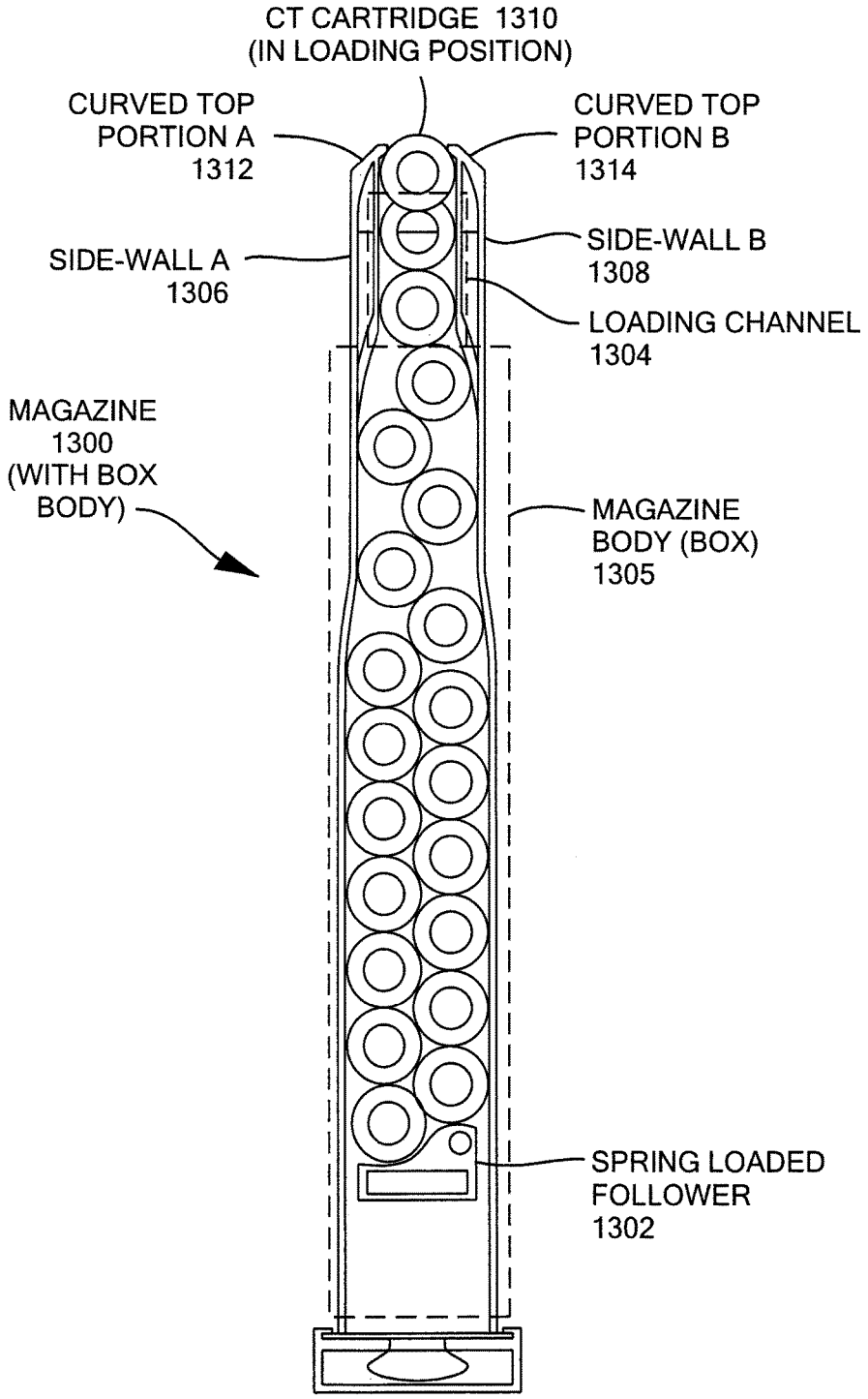
FIG. 13 is a side cut away view of another example of a magazine for storing CT cartridges.

FIG. 13 is a side cut away view of another example of a magazine for storing CT cartridges that is configured to prevent the loading of incorrectly oriented CT cartridges. As shown in FIG. 13, a Magazine 1300 includes a Spring-Loaded Follower 1302, a Magazine Body 1305 (e.g. a box), a Loading Channel 1304, and Side-Wall A 1306 and Side-Wall B 1308. Side-Wall A 1306 may include a Curved Top Portion A 1312, and Side-Wall B 1308 may include a Curved Top Portion B 1314. Curved Top Portion A 1312 and Curved Top Portion B 1314 are examples of what are generally referred to as magazine lips. A CT Cartridge 1310 is shown located in a top most position within Magazine 1300, referred to as the loading position. Side-Wall A 1306 and Side-Wall B 1308 may include side-wall ribs projecting into the loading channel (not shown), which prevent backward oriented CT cartridges from passing through the Loading Channel 1304 into the Magazine Body 1305. Accordingly, CT Cartridge 1310 in the loading position will only be allowed to pass through Loading Channel 1304 if CT Cartridge 1310 is correctly oriented, resulting in a circumferential groove in CT Cartridge 1310 becoming engaged with the side-wall ribs as CT Cartridge 1310 is pushed down through the Loading Channel 1304.

Figure 14:
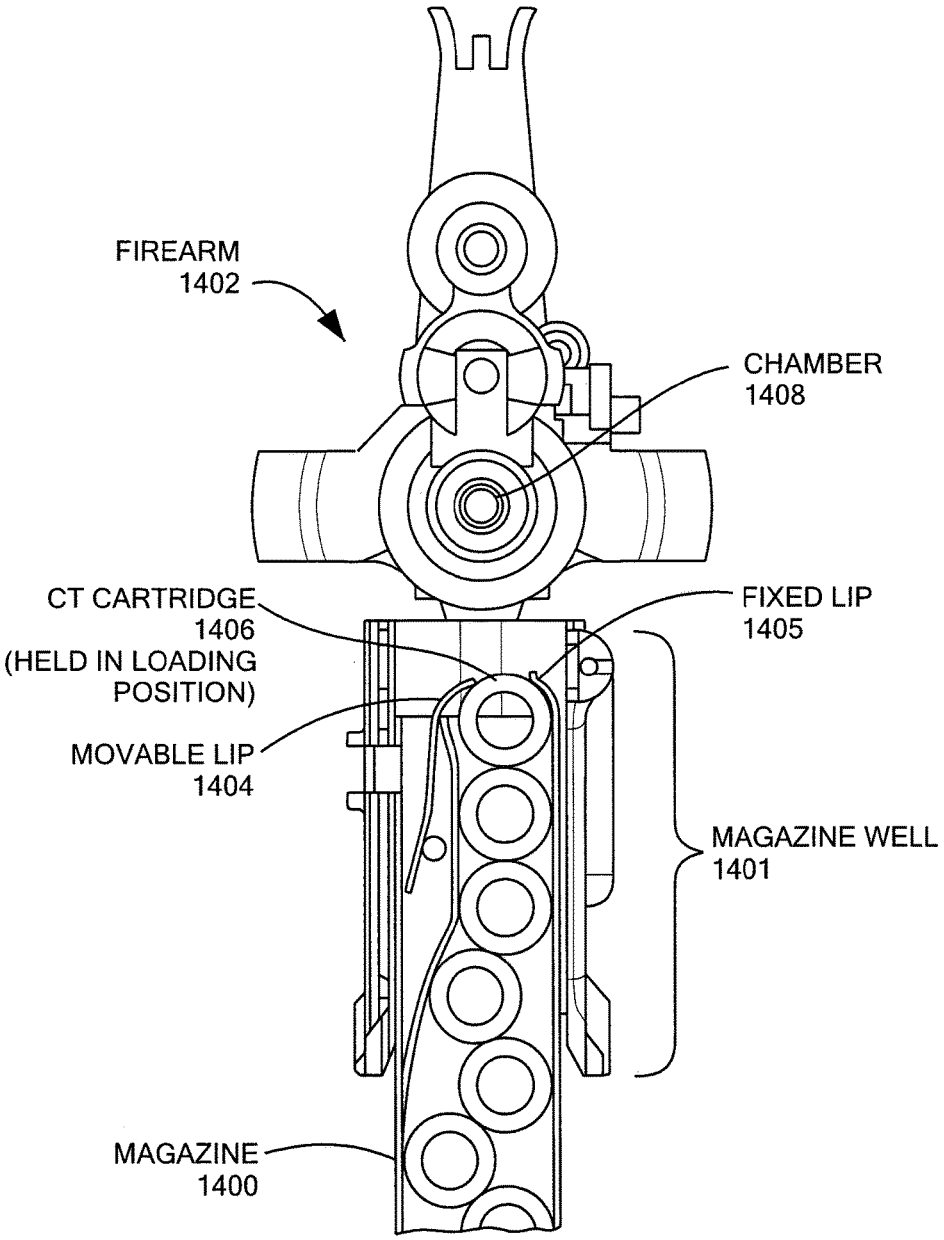
FIG. 14 shows an example of a magazine for storing CT cartridges with a moveable lip, and showing the magazine being inserted into a magazine well of a firearm configured to fire CT cartridges.

FIG. 14 is a cross section diagram showing an example of a Magazine 1400 for storing CT cartridges, with a Moveable Lip 1404. In FIG. 14, the Magazine 1400 is in the process of being inserted into a Magazine Well 1401 of a Firearm 1402 that is configured to fire CT cartridges. The Firearm 1402 includes a Chamber 1408 in which CT cartridges are loaded fired. Magazine 1400 is shown including a CT Cartridge 1406 located in a top-most position of the Magazine 1400. A spring-loaded follower (not shown) in Magazine 1400 pushes upward against the CT cartridges loaded in Magazine 1400, but Moveable Lip 1404 and Fixed Lip 1405 are preventing the CT Cartridge 1406 in the loading position at the top of Magazine 1400 from being pushed out of the top of Magazine 1400.

Figure 15:
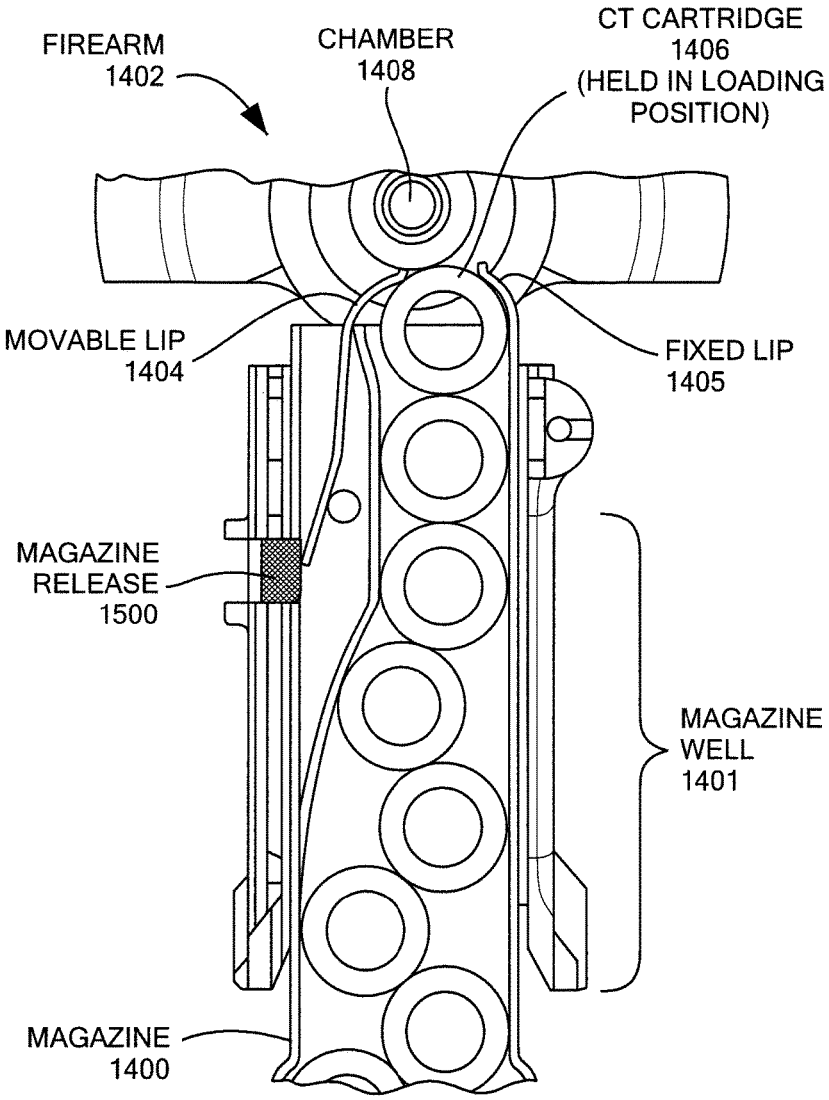
FIG. 15 shows the magazine of FIG. 14 being locked into the magazine well of the firearm.

FIG. 15 shows the Magazine 1400 fully inserted into the Magazine Well 1401, and in the process of locking into the Magazine Well 1401 of the Firearm 1402. In FIG. 15, a Magazine Release 1500 mechanism is positioned over a lower end of the Moveable Lip 1404, but is not yet in a depressed and locked position. Moveable Lip 1404 and Fixed Lip 1405 are still preventing the CT Cartridge 1406 in the loading position at the top of Magazine 1400 from being pushed out of the top of Magazine 1400.

Figure 16:
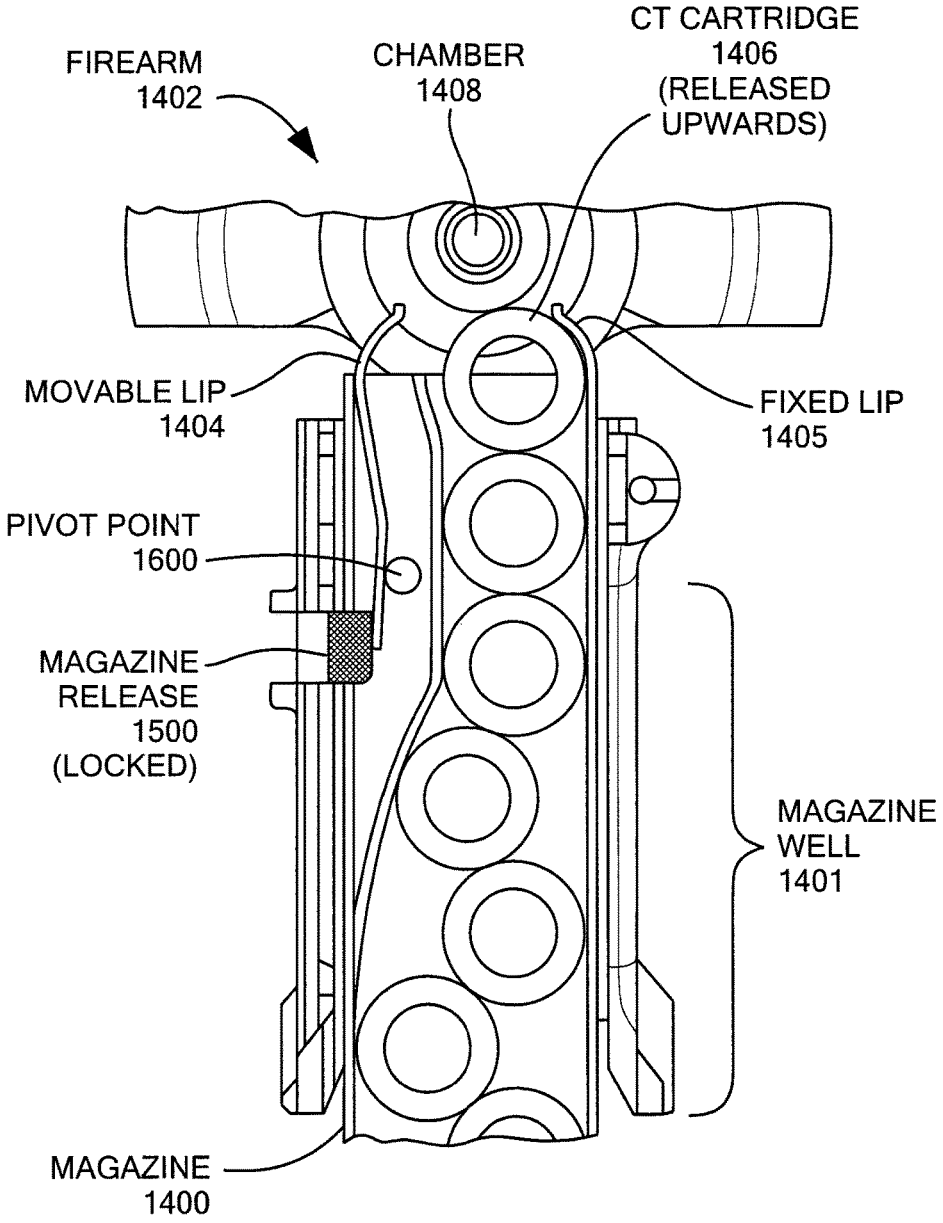
FIG. 16 shows the magazine of FIG. 14 after being locked into the magazine well of the firearm, with the magazine release button having pivoted the moveable lip out of the way of the top, allowing the top most CT cartridge to be pushed upwards out of a top of the magazine into alignment with a chamber of the firearm.

FIG. 16 shows the Magazine 1400 fully inserted and locked into the Magazine Well 1401 of the Firearm 1402. In FIG. 16, the Magazine Release 1500 mechanism is in a depressed and locked position, pushing against the lower end of the Moveable Lip 1404, causing Moveable Lip 1404 to pivot laterally on the Pivot Point 1600 and out of the way of the CT Cartridge 1406 located in the loading position. For example, the Magazine Release 1500 may be spring loaded and move to the depressed and locked position shown in FIG. 16 through a matching hole in the side of Magazine 1400 when the Magazine Release 1500 becomes aligned with the hole when Magazine 1400 fully inserted into Magazine Well 1401, thus allowing Magazine Release to push against the lower end of the Moveable Lip 1404 while Magazine 1400 is locked in Magazine Well 1401. With Moveable Lip 1404 pivoted out of the way of the CT Cartridge 1406 located in the loading position, CT Cartridge 1406 is fed vertically out of the top of Magazine 1400 into alignment with the Chamber 1408 of Firearm 1402, thus allowing CT Cartridge 1406 to be loaded into Chamber 1408 and fired. Fixed Lip 1406 may be a fixed magazine lip that does not move when Moveable Lip 1404 is pivoted out of the way of CT Cartridge 1406.

Figure 17:
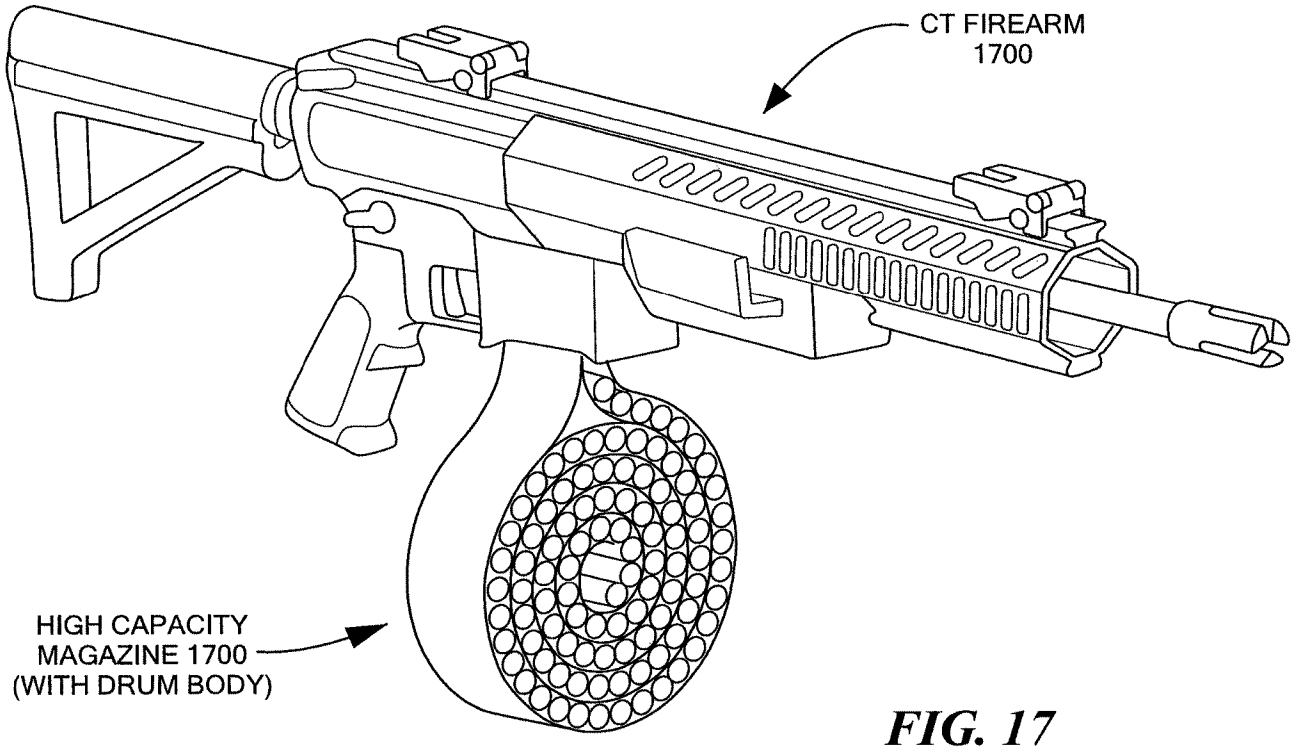
FIG. 17 shows a firearm configured to fire CT cartridges, and having a high capacity magazine for storing CT cartridges attached thereto.

FIG. 17 shows an example of a firearm configured to fire CT cartridges, e.g. CT Firearm 1700. As shown in FIG. 17, CT Firearm 1700 may have a High Capacity Magazine 1700 attached thereto. The High Capacity Magazine 1700 shown in FIG. 17 has a drum shaped body.

Figure 18:
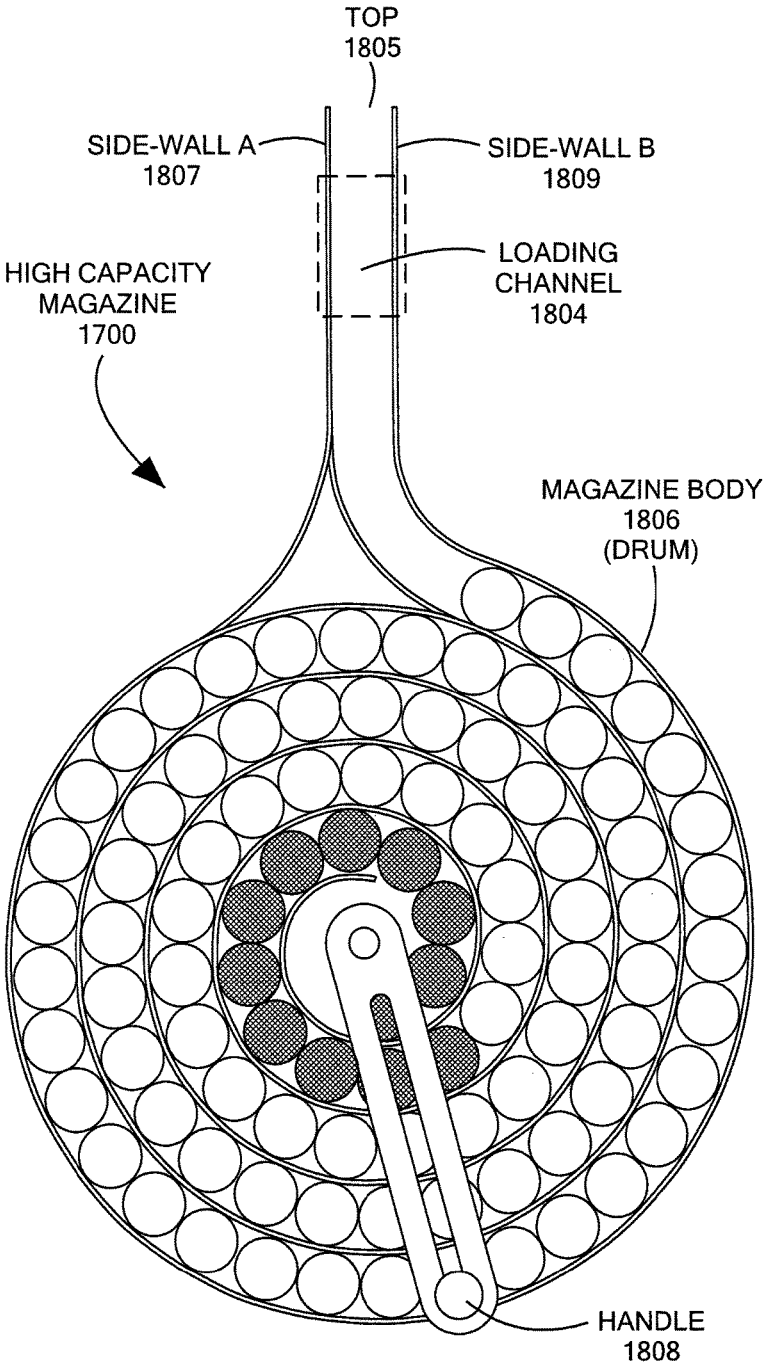
FIG. 18 shows a side cut away view of the high capacity magazine for storing CT cartridges.

FIG. 18 shows a side cut away view of the High Capacity Magazine 1700. As shown in FIG. 18, High Capacity Magazine 1700 may include a Loading Channel 1304. Side-walls (e.g. Side-Wall A 1807 and Side-Wall B 1809) of the Loading Channel 1304 may include side-wall ribs projecting into Loading Channel 1804, for engagement with circumferential grooves in correctly oriented CT cartridges that are manually fed into a Top 1805 of High Capacity Magazine 1700. In contrast, if a backward CT cartridge is manually fed into Top 1805, the side-wall ribs in the Loading Channel 1804 will prevent the backward CT cartridge from passing downward through Loading Channel 1804 into the Magazine Body 1806. A Handle 1808 may be provided in some embodiments to wind down a ribbon spring or the like that pushes the CT cartridges out of Top 1805 while manually loading the High Capacity Magazine 1700 through the Top 1805.

Figure 19:
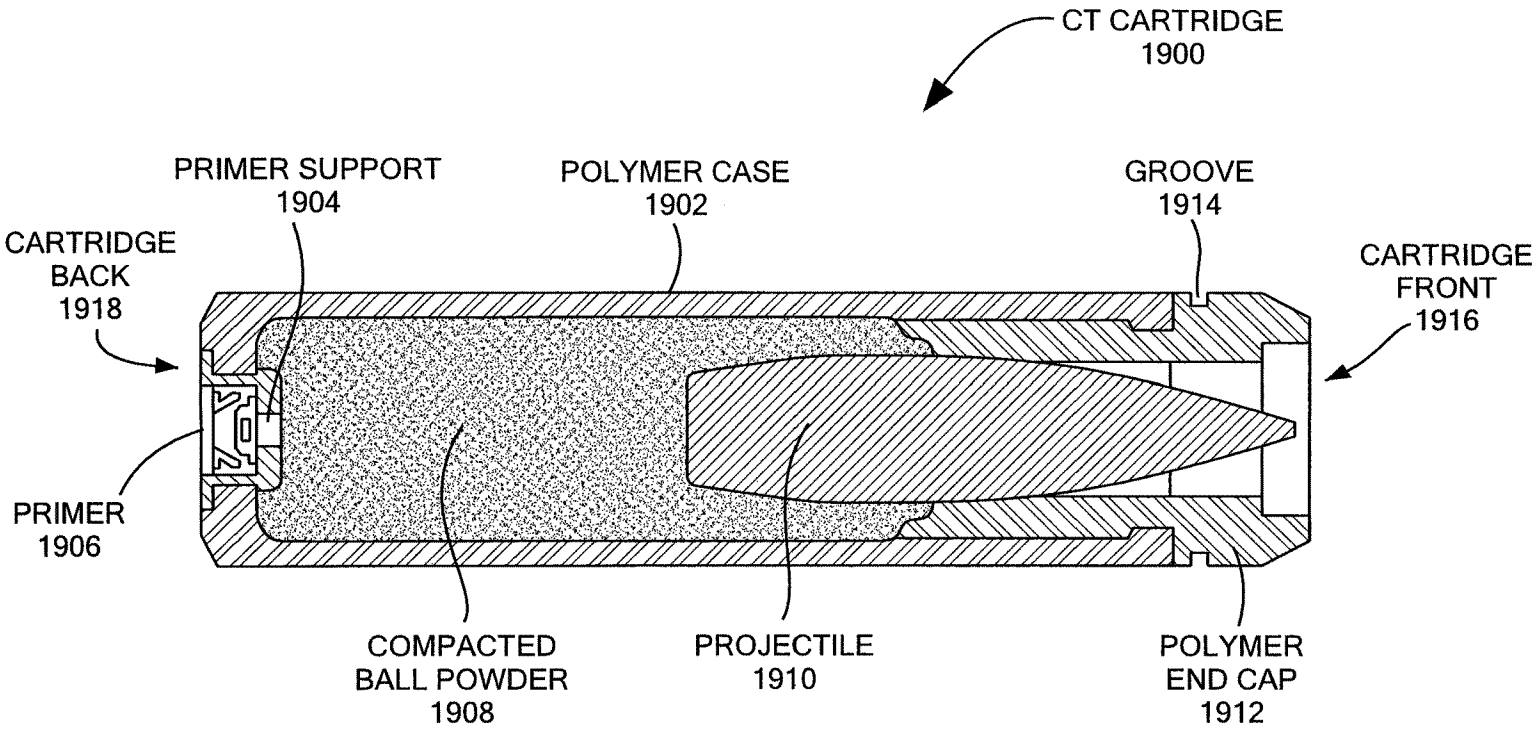
FIG. 19 shows a profile view of an illustrative CT cartridge.

FIG. 19 shows a profile cutaway view of an example of a CT Cartridge 1900. As shown in FIG. 19, the example CT Cartridge 1900 includes a Polymer Case 1902, Primer Support 1904, Primer 1906, Compacted Ball Powder 1908, a Projectile 1910, and a Polymer End Cap 1912. FIG. 19 also shows a Cartridge Back 1918 and a Cartridge Front 1916 of CT Cartridge 1900.

Figure 20:
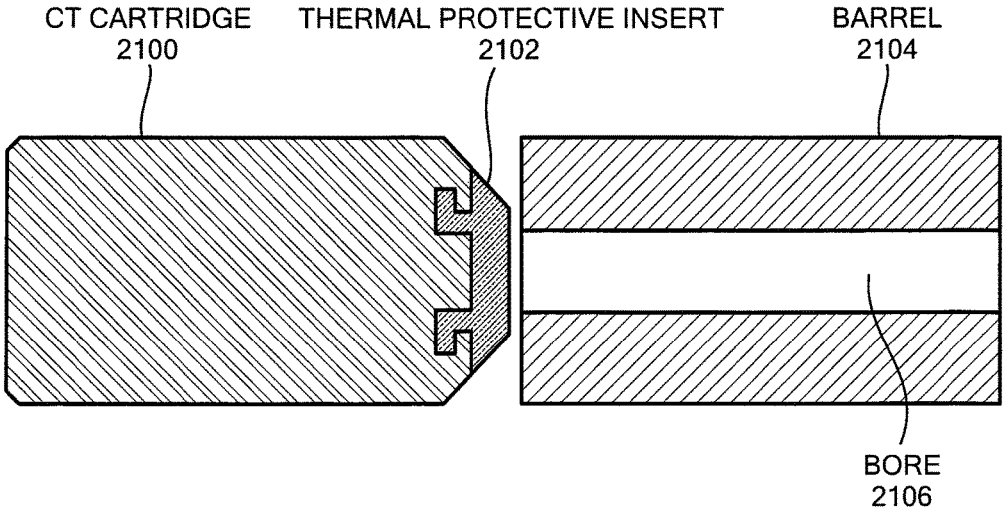
FIG. 20 shows a simplified profile view of a CT cartridge having a thermal protective insert located at the front end of the cartridge.
Figure 21:
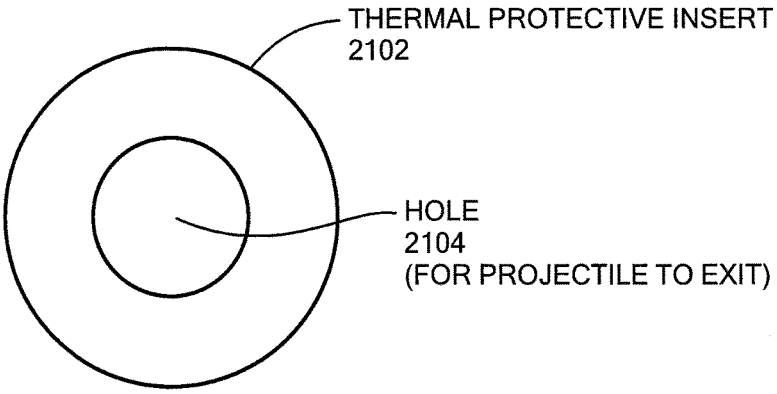
FIG. 21 shows an end view of a thermal protective insert for a CT cartridge, the thermal protective insert having a hole to allow a projectile exiting the CT cartridge to pass through the thermal protective insert into the bore of a barrel of the firearm when the CT cartridge is fired.

FIG. 20 shows a simplified profile cutaway view of a CT Cartridge 2100 having a Thermal Protective Insert 2102 at its front end. In some embodiments, each CT cartridge to be loaded into the magazine described herein may include a thermal protective insert located in a front end of the cartridge, such as Thermal Protective Insert 2102. Thermal Protective Insert 2102 provides thermal insulation from heat emanating from the Barrel 2104 of a firearm to which the magazine is attached when the CT Cartridge 2100 is fed out of the magazine and into a chamber of the firearm. In particular, in a closed bolt configuration, CT Cartridge 2100 may be loaded into the chamber of the firearm after a previous CT cartridge was fired, potentially resulting in CT Cartridge 2100 sitting adjacent to or even in contact with Barrel 2104, which may become hot as multiple CT cartridges are fired. By insulating the rest of the CT Cartridge 2100 from heat emanating from the Barrel 2104 of the firearm into which the CT Cartridge 2100 is loaded, Thermal Protective Insert 2101 prevents such heat from causing damage to the polymer casing of the CT Cartridge 2100, and/or causing the CT Cartridge 2100 to inadvertently fire. Thermal Protective Insert 2102 may be made of any appropriate type of thermal insulating material, including but not limited to a ceramic and/or carbon. Thermal Protective Insert 2102 may be integrated into or attached to the front of CT Cartridge 2100 using various specific techniques, including but not limited to insert molding, snapping of the Thermal Protective Insert 2102 into place, or by way of using an adhesive to attach Thermal Protective Insert 2012 to the front of CT Cartridge 2100. FIG. 21 shows an end view of the Thermal Protective Insert 2102, and showing that Thermal Protective Insert 2102 has a Hole 2104 to allow a projectile contained in the CT cartridge to exit the CT cartridge through the Hole 2104 into the Bore 2106 of the Barrel 2104 when the CT Cartridge 2100 is fired (See FIG. 20).

While the invention is described through the above exemplary embodiments, it will be understood by those of ordinary skill in the art that modification to and variation of the illustrated embodiments may be made without departing from the inventive concepts herein disclosed.

What is claimed is:

1. A magazine configured to store cased telescoped (CT) cartridges and deliver the CT cartridges to a firearm, comprising:

two side-walls extending along a length of a loading channel;

two end-walls extending along a width of the loading channel, connecting the sidewalls; and wherein each one of the side-walls includes a vertically extending side-wall rib that projects inwards into the loading channel, wherein the side-wall ribs are located opposite each other and positioned in alignment with a location of a circumferential groove in each CT cartridge to be loaded into the magazine, such that the side-wall ribs prevent a backwards oriented CT cartridge from being pushed from a loading position in the magazine through the loading channel into a body of the magazine.

2. The magazine of claim 1, further comprising a spring-loaded follower having a predominantly rectangular top shape matching a rectangular profile of the CT cartridges to be loaded into the magazine; and wherein the top shape of the spring-loaded follower further includes cutaways corresponding to the side-wall ribs that allow the spring-loaded follower to move upwards and downwards through the loading channel without interference from the side-wall ribs.

3. The magazine of claim 2, wherein a front one of the end-walls defines at least a portion of a loading window through which a CT cartridge can be loaded axially into the loading position; and wherein the side-wall ribs are located below the loading position, such that the side-wall ribs do not interfere with loading the CT cartridge axially into the loading position through the loading window.

4. The magazine of claim 3, wherein a back one of the end-walls prevents the CT cartridge from being pushed axially out of the magazine from the loading position.

5. The magazine of claim 4, wherein after loading a CT cartridge into the loading position, the CT cartridge must be pushed downwards past the side-wall ribs to be loaded into the body of the magazine.

6. The magazine of claim 5, wherein the body of the magazine comprises a box.

7. The magazine of claim 5, wherein the body of the magazine comprises a drum.

8. The magazine of claim 1, wherein the magazine further comprises a spring-loaded follower configured to push CT cartridges loaded in the magazine upwards towards the loading position;

wherein each of the side-walls includes a top curved portion adjacent to the loading position and curving inwardly over a top of the magazine; and wherein the top curved portions of the side-walls prevent a CT cartridge located in the loading position from being pushed by the spring-loaded follower upwards out of the top of the magazine.

9. The magazine of claim 8, wherein the top curved portion of a first one of the side-walls comprises a moveable lip configured to move laterally out of the way of the CT cartridge located in the loading position, in response to attaching the magazine to a firearm, in order to allow the CT cartridge located in the loading position to be fed vertically out of the magazine into the firearm to which the magazine is attached.

10. The magazine of claim 9, wherein the curved portion of a second one of the side-walls comprises a fixed lip that does not move.

11. The magazine of claim 1, wherein each CT cartridge to be loaded into the magazine includes a thermal protective insert located in a front end of the cartridge that provides thermal insulation from heat emanating from the barrel of a firearm to which the magazine is attached when the CT cartridge is located in a chamber of the firearm.

* * * * *